United States Patent [19]

Kato et al.

[11] 4,223,582

[45] Sep. 23, 1980

[54] ELECTRONIC MUSICAL INSTRUMENT BY NONLINEARLY ADDRESSING WAVEFORM MEMORY

[75] Inventors: Mitsumi Kato; Koji Niimi, both of Hamamatsu, Japan

[73] Assignee: Nippon Gakki Seizo Kabushiki Kaisha, Hamamatsu, Japan

[21] Appl. No.: 953,440

[22] Filed: Oct. 23, 1978

[30] Foreign Application Priority Data

Oct. 26, 1977 [JP] Japan ..... 52-127634

[51] Int. Cl.[3] ..... G10H 1/00

[52] U.S. Cl. ..... 84/1.01; 84/1.19; 328/16

[58] Field of Search ..... 84/1.01, 1.04, 1.19, 84/1.24, 1.25; 328/14, 16; 364/718, 721, 729; 332/16 R

[56] References Cited

U.S. PATENT DOCUMENTS

| | | | |
|---|---|---|---|
| 3,515,792 | 6/1970 | Deutsch | 84/1.03 |
| 3,633,017 | 1/1972 | Crooke | 364/721 |
| 3,809,786 | 5/1974 | Deutsch | 84/1.01 |
| 3,882,751 | 5/1975 | Tomisawa et al. | 84/1.01 |
| 3,952,623 | 4/1976 | Deutsch | 84/1.25 |
| 4,127,047 | 11/1978 | Tomisawa | 84/1.01 |

*Primary Examiner*—J. V. Truhe
*Assistant Examiner*—Forester W. Isen
*Attorney, Agent, or Firm*—Charles E. Pfund

[57] ABSTRACT

In an electronic musical instrument wherein a frequency information related to the tone pitch of a depressed key is repeatedly accumulated and the progressing accumulated value is used to designate the addresses of a waveform memory device storing the waveform of a desired musical tone, the frequency information is varied with time instantaneously so as to vary the speed of addressing the waveform memory and thereby to vary the waveform read out from the waveform memory device, thus changing the color of the produced musical tone.

4 Claims, 8 Drawing Figures

ELECTRONIC MUSICAL INSTRUMENT BY NONLINEARLY ADDRESSING WAVEFORM MEMORY

BACKGROUND OF THE INVENTION

This invention relates to an electronic musical instrument of a waveform memory read out type in which the amplitude values at respective sampling points adapted to form a waveform corresponding to one period of a desired musical tone waveform are read out from the addresses of a waveform memory device by designating the addresses with an increasing accumulated value obtained by repeatedly accumulating a constant (hereinafter termed a frequency information) corresponding to the pitch of the tone of a depressed key at a constant speed for producing a musical tone signal.

An electronic musical instrument of a waveform memory read out type is provided with a frequency information memory device which stores a frequency information F corresponding to the tone pitches of respective keys and the addresses of the frequency information memory device are designated by a key information representing a depressed key so as to read out a corresponding frequency information F and the read out frequency information F is repeatedly accumulated at a constant speed to obtain an increasing accumulated value qF (where q=1, 2, 3 . . . ). This accumulated value is used for sequentially designating the addresses of a waveform memory device in which the amplitude values of successive sampling points which form one period of a desired musical tone waveform have been stored thus sequentially reading out the amplitude values at respective sampling points to form a musical tone signal.

For the sake of simplicity, the explanation is done herein with respect to examples of a monophonic type.

FIG. 1 of the accompanying drawing is a block diagram showing one example of a prior art electronic musical instrument of a waveform memory read out type. In FIG. 1, a key switch circuit 1 provided for a keyboard not shown includes a plurality of key switches $2_1$ through $2_n$ corresponding to respective keys, not shown. Assume now that the number of keys is 61, for example. The normally closed stationary contacts a and the movable contacts c of respective key switches are connected in series to form a priority circuit (i.e. preferential connection). The lowest movable contact c supplied with a signal "1" has the first priority. The outputs of the normally opened contacts b are sent out in parallel as a key data KD and through an OR gate circuit 3 as a key-on signal KON shown in FIG. 2A and representing that any of the keys are depressed. A differential circuit 4 for differentiating the build-up portion of the key-on signal KON supplies a differentiated pulse DP shown in FIG. 2B to a control terminal 5*a* of a read/-write memory device 5 in which the key data KD produced by the key switch circuit 1 are written by the differentiated pulse DP. Thereafter, the written key data KD are continuously produced until the next differentiated pulse DP is applied. An address signal generating circuit 6 is provided to produce an address signal for reading a waveform memory device 9 to be described later. The address signal generating circuit 6 comprises a frequency information memory device 7 having addresses respectively storing the frequency informations F corresponding to the tone pitches of respective keys and controlled by the key data KD produced by the read/write memory device 5 for reading the addresses thereof, and an accumulator 8 for sequentially adding the frequency informations F read out from the frequency information memory device 7 under the timing action of a clock pulse $\phi$ to produce an increasing accumulated value qF (where q=1, 2, 3 . . . ) as an address signal. The waveform memory device 9 succeeding the accumulator 8 has addresses in which the sampling point amplitude values of a desired musical tone waveform are stored and the addresses are designated by the progressing accumulated value qF produced by the accumulator 8 to read out the musical tone waveform stored therein. The key-on signal KON produced by the key switch circuit 1 and the differentiated pulse DP produced by the differentiating circuit 4 are applied to an envelope control waveform generator 10. The operation of the envelope control waveform generator 10 is initiated by the key-on signal KON to form an envelope waveform signal EC for controlling the volume envelope of the musical tone comprising an attack section, a first decay section, a sustain section and a second decay section as shown in FIG. 2C.

The envelope control waveform generator 10 is reset by the differentiated pulse DP and its count value is produced as a count signal CP. This generator 10 comprises a counter 11 having 10 bits for example, an attack clock pulse oscillator 12 which produces an attack clock pulse AC, a decay clock pulse oscillator 13 which produces a decay clock pulse DC, an inverter 14 which inverts the key-on signal KON, an inverter 15 which inverts the most significant bit signal MSB of the count signal produced by the counter 11, an AND gate circuit 18 having inputs supplied with the key-on signal KON, the output $\overline{MSB}$ of the inverter 15 and the attack clock pulse AC, and an AND gate circuit 17 having inputs supplied with the output $\overline{KON}$ of the inverter 14, the most significant bit signal MSB and the decay clock pulse DC, an OR gate circuit 18 which supplies the sum of the outputs of AND gate circuits 16 and 17 to one input of the counter 11, and an envelope waveform memory circuit 19 having addresses storing respective sampling point amplitude values of the envelope waveform signal EC, the addresses being designated by the count signal CP produced by the counter 11 for producing the envelope waveform signal EC shown in FIG. 2C. As shown in FIG. 2C, the attack section and the first decay section of the waveform are stored in the addresses [0] to [512] of the envelope waveform memory device 19 and the second decay section of the waveform is stored in the addresses [513] to [1023]. A multiplier 20 connected to the output side of the envelope waveform memory device 19 multiplies the musical tone waveform read out from the waveform memory device 9 with the envelope waveform signal EC read out from the envelope waveform memory device 19 to apply a volume envelope to the musical tone signal. The musical tone signal applied with the volume envelope is sent to a sound system 21 from the multiplier 20 to produce a musical tone. When one or more keys of the keyboard are depressed key switches (one or more of $2_1$–$2_n$) corresponding to the depressed keys are operated and a keyswitch having the first priority among the operated key switches produces a signal "1" which is used as a key data KD while the key data KD is being produced by the key switches $2_1$–$2_n$, OR gate 3 continuously produces a key-on signal KON shown in FIG. 2A. The build-up portion of the key-on signal KON is differentiated by the differential circuit 4 to produce a differentiated pulse DP shown in FIG. 2B which is applied to the read/write control terminal 5*a* of the read/write memory device 5. During an interval in which the differentiated pulse DP is being applied, the content of the read/write memory device 5 is changed to the key data KD supplied from the key switch circuit 1 and thereafter the read/write memory device 5 continues to produce its content until the next differentiated pulse DP is applied thereto. Thus, the read/write memory device 5 continuously produces the same key data KD until another key is depressed to produce another key-on signal KON.

The frequency information memory device 7 of the address signal generating circuit 6 is addressed by the key data KD produced by the read/write memory device 5 to produce a frequency information shown in the following table 1 and corresponding to the tone pitch of the depressed key.

TABLE 1

| Binary digit Key name | Integer part $F_{15}$ | Fractional Part $F_{14}$ | $F_{13}$ | $F_{12}$ | $F_{11}$ | $F_{10}$ | $F_9$ | $F_8$ | $F_7$ | $F_6$ | $F_5$ | $F_4$ | $F_3$ | $F_2$ | $F_1$ | F number |
|---|---|---|---|---|---|---|---|---|---|---|---|---|---|---|---|---|
| $C_2$ | 0 | 0 | 0 | 0 | 0 | 1 | 1 | 0 | 1 | 0 | 1 | 1 | 0 | 0 | 1 | 0.052325 |
| $C_3$ | 0 | 0 | 0 | 0 | 1 | 1 | 0 | 1 | 0 | 1 | 1 | 0 | 0 | 1 | 0 | 0.104650 |
| $C_4$ | 0 | 0 | 0 | 1 | 1 | 0 | 1 | 0 | 1 | 1 | 0 | 0 | 1 | 0 | 1 | 0.209300 |
| $C_5$ | 0 | 0 | 1 | 1 | 0 | 1 | 0 | 1 | 1 | 0 | 0 | 1 | 0 | 1 | 0 | 0.418600 |
| $C_6$ | 0 | 1 | 1 | 0 | 1 | 0 | 1 | 1 | 0 | 0 | 1 | 0 | 1 | 0 | 0 | 0.837200 |
| $D\#_6$ | 0 | 1 | 1 | 1 | 1 | 1 | 1 | 1 | 0 | 1 | 1 | 1 | 0 | 0 | 0 | 0.995600 |
| $E_6$ | 1 | 0 | 0 | 0 | 0 | 1 | 1 | 1 | 0 | 0 | 0 | 0 | 0 | 0 | 1 | 1.054808 |
| $C_7$ | 1 | 1 | 0 | 1 | 0 | 1 | 1 | 0 | 0 | 1 | 0 | 1 | 0 | 0 | 1 | 1.674400 |

The frequency information F read out from the frequency information memory device 7 and corresponding to the tone pitch of the depressed key is repeatedly accumulated by accumulator 8 at the frequency of the clock pulse $\phi$ to form the progressing accumulated value qF (q=1, 2, 3, . . . ) which is used as an address signal for sequentially designating the addresses of the waveform memory device 9 to sequentially read out the sampling point amplitude values of the musical tone waveform stored in respective addresses.

The key-on signal KON generated by the key switch circuit 1 is also supplied to the envelope control waveform generator 10 so as to produce therefrom an envelope waveform signal EC having an attack section, a sustain section and a decay section as shown in FIG. 2C as the key-on signal KON.

The operation of the envelope control waveform generator 10 will now be described in detail. When the key-on signal KON is generated, the differential circuit 4 produces a differentiated pulse DP in synchronism with the build-up of the key-on signal KON. The differentiated pulse DP resets the 10 bit counter 11. As a consequence, all 10 bit count signals CP produced by the counter 11 are "0" so that the output $\overline{MSB}$ of the inverter 15 which inverts the most significant bit signal MSB of the count signal CP is "1". Consequently, the AND gate circuit 16 supplied with the key-on signal KON, the output signal $\overline{MSB}$ of the inverter 15 and the attack clock pulse AC produced by the attack clock pulse oscillator 12 is enabled to supply the attack clock pulse AC to the count input terminal of the counter 11 via AND gate circuit 16 and OR gate circuit 18. Then, the counter 11 sequentially counts the attack clock pulse AC to supply its count signal CP to the envelope waveform memory device 19 to designate its addresses. In this manner, the content stored in the respective addresses of the envelope waveform memory device 19 is sequentially read out starting from address 0. At this time, when the most significant bit signal MSB of the count signal CP produced by the counter 11 becomes "1", that is when the count signal CP reaches [512], the output $\overline{MSB}$ of the inverter 15 becomes "0" thus disenabling the AND gate circuit 16 with the result that the counting operation of the counter 11 caused by the attack clock pulse AC is stopped. Accordingly, the addresses [0] to [512] of the envelope waveform memory device 19 addressed by the count signal CP produced by the counter 11 are sequentially read out by the timing operation of the attack clock pulse AC generated by the attack clock pulse oscillator 12 at the time of generating the key-on signal KON. Accordingly, the attack section and the first decay portion of the envelope waveform EC are generated as shown in FIG. 2C. Thereafter, the amplitude value stored in the address [512] of the envelope waveform memory device 19 which is designated by the count signal CP when the counter 11 stops its counting operation is continuously read out as the sustain section having a constant voltage level of the amplitude.

When the depressed key is released and as the key-on signal KON falls down (that is becomes "0") the output $\overline{KON}$ of the inverter 14 becomes "1" thus enabling the AND gate circuit 17. As a consequence, counter 11 counts up the delay pulse DC supplied through AND gate circuit 17 and OR gate circuit 18 starting from said count value [512]. When the count valve reaches [1023], the counter 11 overflows to become an all zero state. As a consequence, the AND gate circuit 17 is disenabled to stop the counting operation. As above described, the counter 11 is caused to count up beyond [1023] until the all zero state is reached by the decay clock pulse DC produced by the decay clock pulse oscillator 13 when the key is released. By this count signal CP the amplitude values which have been stored in the addresses [513] to [1023] of the envelope waveform memory device 19 are sequentially read out to form the second decay section shown in FIG. 2C. Above description relates to the operation of the envelope control waveform generator which is started by the key-on signal KON.

The envelope waveform signal thus generated is multiplied by the musical tone waveform generated by the waveform memory device 9 in the multiplier 20 thus applying the volume envelope to the musical tone signal. The musical tone signal applied with the volume envelope in this manner is converted into a musical tone by the sound system 21. This operation is similar to the method of forming a single tone by an electronic musical instrument of the waveform memory read out type which is disclosed in N. Tomisawa et al U.S. Pat. No. 3,882,751 dated May 13, 1975.

As above described in the electronic musical instrument thus far described, the frequency informations corresponding to the tone pitches of respective keys are stored in the frequency information memory device 7 and when keys are depressed the frequency informations corresponding to the tone pitches of the depressed keys are read out. The read out frequency informations are accumulated at a predetermined speed to obtain an increasing accumulated value qF which is used for sequentially reading out the sampling points amplitude values of one period of the musical tone waveform so as to produce a musical tone signal. Consequently, once the waveform stored in the waveform memory device is set, the waveform of the musical tone read out therefrom is always the same so that it is impossible to change the waveform that is the tone color.

According to another proposal, a plurality of waveform memory devices adapted to store different musical tone waveforms are provided and the tone color is changed by selectively reading the waveform memory devices. Such arrangement is disclosed in R. Deutsch U.S. Pat. No. 3,515,792 dated June 2, 1970 for example.

However, the electrical musical instrument disclosed therein is complicated in construction because it comprises a plurality of waveform memory device and because it is difficult to store complicated musical tone waveforms in the waveform memory devices.

SUMMARY OF THE INVENTION

It is therefore an object of this invention to provide an improved electronic musical instrument of a waveform memory device read out type in which it is possible to readily change the musical tone waveform read out from the waveform memory device.

Briefly stated the electronic musical instrument embodying the invention comprises frequency information generating means which generates a frequency information related to a tone pitch of a depressed key, frequency information varying means for instantaneously varying the frequency information with time, accumulating means for repeatedly accumulating the varying frequency information, a waveform memory device having a plurality of addresses in which sampling point amplitude values forming a waveform corresponding to one period of a desired musical tone waveform are stored, means for designating the addresses by an accumulated value produced by the accumulating means, and a second system for converting a musical tone waveform read out from the waveform memory device into a musical tone.

DESCRIPTION OF THE PREFERRED EMBODIMENTS

Figure 1:
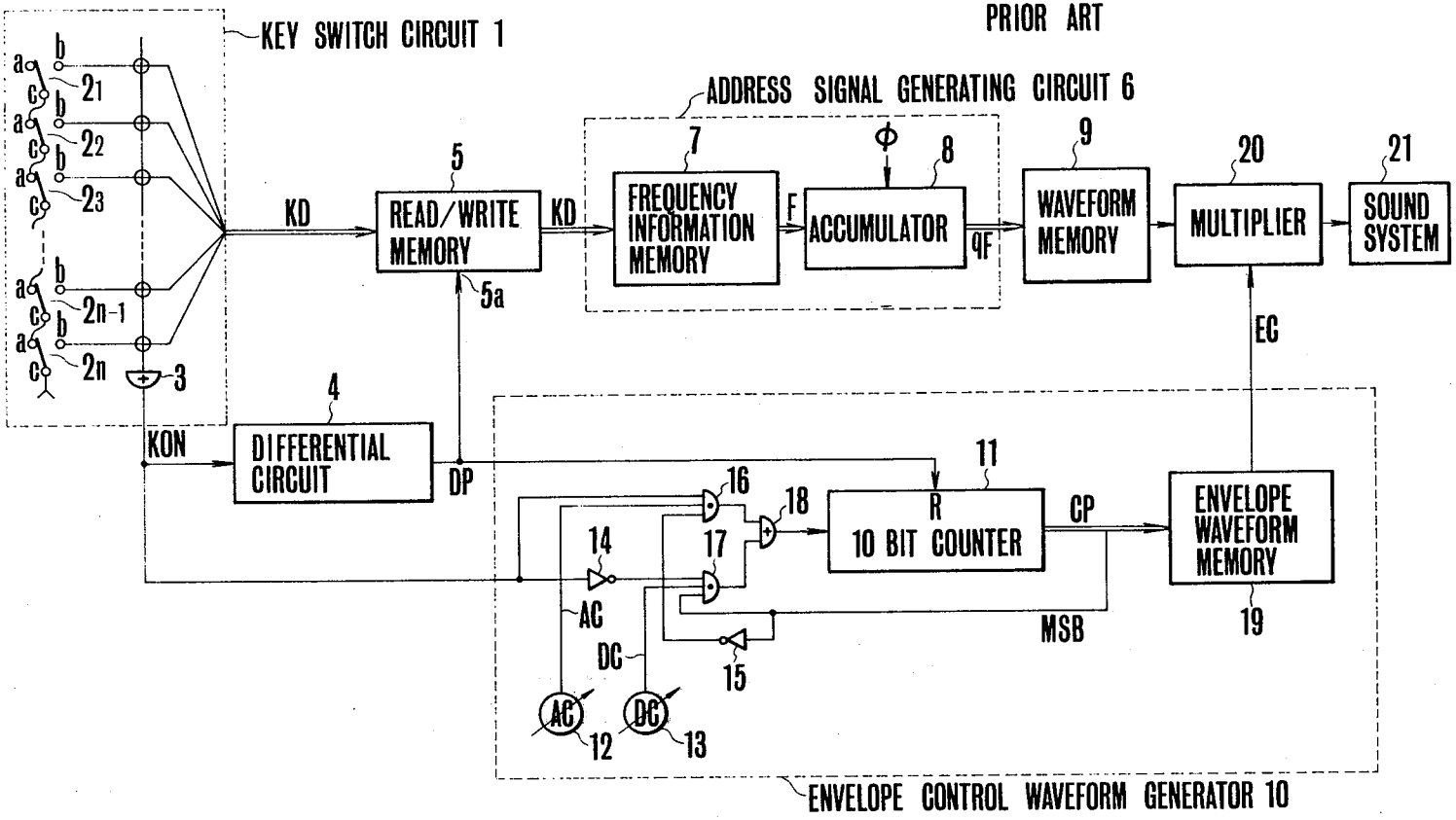
FIG. 1 PRIOR ART
FIG. 1 is a block diagram showing one example of the prior art electronic musical instrument of the waveform memory read out type.
Figures 2A, 2B, 2C:
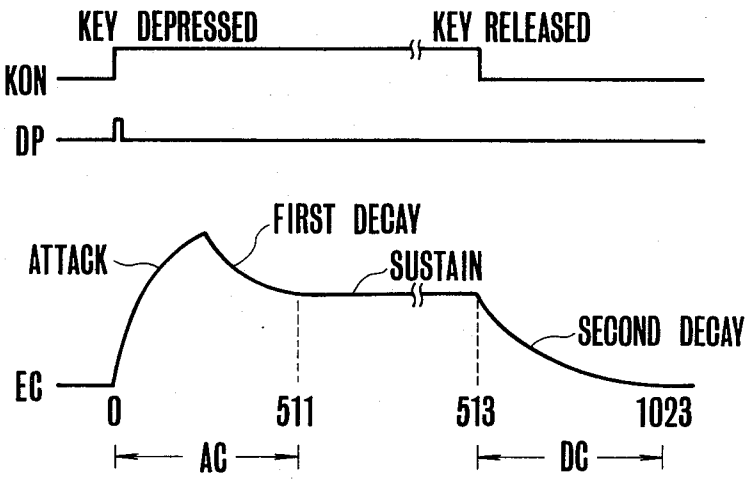
FIGS. 2A, 2B and 2C are waveform charts useful to explain the operation of various elements shown in FIG. 1.
Figure 3:
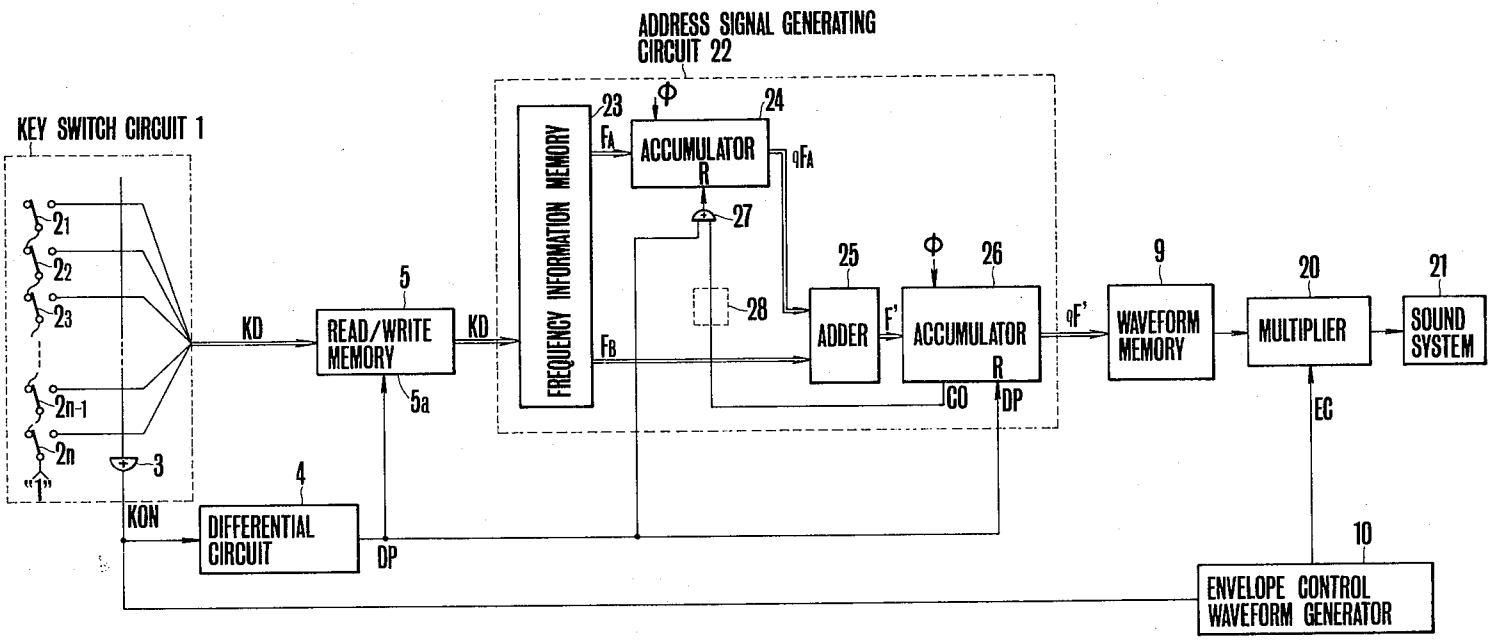
FIG. 3 is a block diagram showing one embodiment of the electronic musical instrument according to this invention.

In FIG. 3 showing a preferred embodiment of the electronic musical instrument of this invention elements corresponding to those shown in FIG. 1 are disignated by the same reference characters. In this embodiment, the element characterizing the invention comprises an improved address signal generating circuit 22. Like the prior art circuit shown in FIG. 1, the frequency information memory deivce 23 of the address signal generating circuit 22 is addressed by the key data KD supplied from the read/write memory device 5 to read out the data stored therein. However, in this frequency information memory device 23, the frequency informations $F_A$ and $F_B$ corresponding to each of the tone pitches of respective keys are stored in respective addresses of the memory device 23. The accumulator 24 sequentially accumulates the frequency information $F_A$ read out from the frequency information memory device 23 under control of the clock pulse $\phi$ so as to produce the accumulated value $qF_A$. An adder 25 is provided to add the accumulated value $qF_A$ produced by the accumulator 24 to the frequency information $F_B$ produced by the frequency information memory device 23 so as to produce a frequency information $F'=(qF_A+F_B)$. A second accumulator 26 is provided to sequentially accumulate the frequency information F' produced by the adder 25 under control of the clock pulse $\phi$ to produce an accumulated value qF' as an address signal for reading the waveform memory device 9. The second accumulator 26 is reset by the differentiated pulse DP synchronous with the build-up of the key-on signal KON produced by the differential circuit 4. An OR gate circuit 27 is provided to apply to the reset terminal R of the first accumulator 24 the differentiated pulse DP and the carry out signal CO of the second accumulator 26.

The electronic musical instrument described above operates as follows. Thus, the read/write memory device 5 produces a key data KD corresponding to a depressed key. When the address of the frequency memory device 23 is designated by the key date KD, the frequency information $F_A$ and $F_B$ related to the tone pitch of the depressed key are read out. The first accumulator 24 is firstly set by the differentiated pulse DP synchronous with the build up of the key-on signal KON and then sequentially accumulates the frequency information $F_A$ produced by the frequency information memory device 23 under control of the clock pulse $\phi$ to produce the accumulated value $qF_A$ which is added by the adder 25 to the frequency information $F_B$ produced by the frequency information memory device 23, thus producing a frequency information F'. After being reset by the differentiated pulse DP which is synchronous with the build-up of the key-on signal KON the second accumulator 26 sequentially accumulates the frequency information F' produced by adder 25 under control of clock pulse $\phi$ to produce the accumulated value qF' as the address signal for reading out the waveform memory device 9. Furthermore, the second accumulator 26 applies its carry out signal CO to the reset terminal R of the first accumulator 24 via OR gate circuit 27 to reset the first accumulator.

Let us now consider the variation in the accumulated value qF′ produced by the address signal generating circuit 22.

The output $qF_A$ of the accumulator 24 varies as follows, each time the clock pusle $\phi$ is produced.

$0, F_A, 2F_A, 3F_A, 4F_A \ldots iF_A$

The output F′ of the adder 25 varies as follows, each time the clock pulse $\phi$ is produced $0+F_B, F_A+F_B, 2F_A+F_B, 3F_A+F_B,$
$4F_A+F_B \ldots iF_A+F_B$ Consequently, the output qF′ of the accumulator 26 varies as follows:

$0+F_B,$
$0+F_B+F_A+F_B,$
$0+F_B+F_A+F_B+2F_A+F_B,$
$0+F_B+F_A+F_B+2F_A+F_B+3F_A+F_B,$

Generally, these variations can be expressed as follows:

$$qF' = \sum_{i=0}^{n-1} (iF_A + F_B)$$
$$= n \cdot F_B + \{1 + 2 + \ldots + (n-1)\} \cdot F_A$$
$$F_A = n \cdot F_B + \frac{n(n-1)}{2}.$$

Figure 4A:
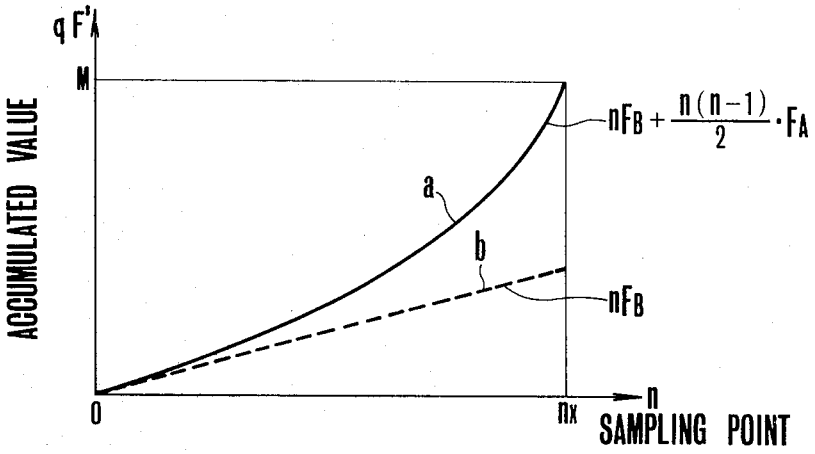
FIGS. 4A and 4B are graphs respectively showing the output of the accumulator and the waveform read out from the waveform memory device respectively and FIG. 5 is a block diagram showing another example of the address signal generating circuit utilized in the electrical musical instrument of this invention.
Figure 4B:
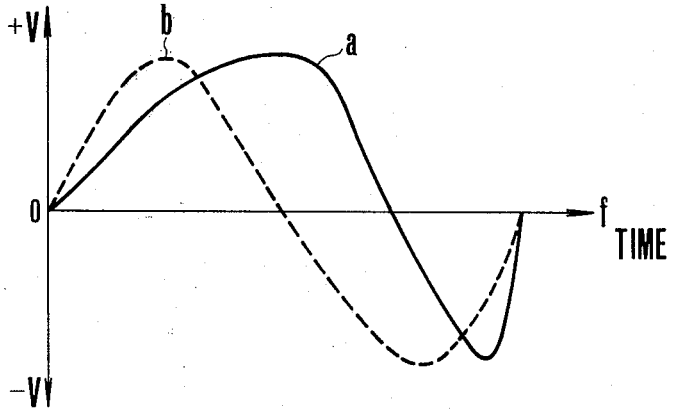

As shown by curve a shown in FIG. 4A, $F_A$ is represented by a curve of the second order which varies monotonically. Consequently, as the frequency information $F_A$ is set to a larger value, the accumulated value qF′ increases more rapidly with the increase in the number of times of the accumulation. When the accumulated value qF′ which varies in this manner is used to designate the addresses of the waveform memory device 9 in which the sampling point amplitude values of one period of a sine wave have been stored, a symmetrical sine wave as shown by dotted line b shown in FIG. 4B would be read out as an asymmetrical or distorted sine wave a in which the positive or first half cycle is widened whereas the negative or second half cycle is compressed. The state of distortion varies variously depending upon the values of the frequency informations $F_A$ and $F_B$ so that when this output signal is used as a musical tone signal it is possible to variously vary the tone color.

The frequency $f_T$ of the musical tone signal at this time is expressed as follows.

More particularly, considering a state in which the accumulated value qF′ of the accumulator 26 becomes equal to the number M of the addresses of the waveform memory device 9.

$$qF = M$$

$$M = n \cdot F_B + [n(n-1)/2] \cdot F_A$$

where n represents the number of the sampling points during one cycle of musical tone waveform expressed by an equation $$n = \frac{F_A - 2F_B + \sqrt{(F_A - 2F_B)^2 + 8 \cdot M \cdot F_A}}{2 \cdot F_A}$$

Consequently, the frequency $f_T$ of the musical tone signal generated is shown by $$f_T = f\phi/n$$

Assuming now that the number of the addresses of the waveform memory device M=1024, the frequency informations $F_A$=0.476190, $F_B$=1.0, then the number of the sampling points n can be calculated as 64 from the equation just described. Where the frequency of the clock pulse $f\phi$ is equal to 28,160 Hz, the frequency $f_T$ of the generated musical tone is as follows.

$$f_T = f\phi/64 = 28160/64 = 440 \text{ Hz}$$

In the embodiment described above, the carry out signal CO of the accumulator 26 is applied to the accumulator 24 which accumulates the frequency information through OR gate circuit for resetting the accumulator, but it is possible to use the carry out signal CO to drive a T type flip-flop circuit 28 shown by dotted lines and to utilize the output of the flip-flop circuit for resetting the accumulator 24. With this modification the accumulator 24 is reset when two carry out signals are generated whereby it is possible to produce a musical tone signal having a complicated waveform comprised by a signal of two periods having a compressed time axis.

When the second accumulated value qF′ of the accumulator 26 reaches its modulo (a maximum accumulatable value), the accumulator produces a carry out signal CO while at the same time its accumulated valve qF′ becomes zero. The carry out signal CO produced by the second accumulator 26 is applied to the reset terminal R of the first accumulator 24 via OR gate circuit 27 to reset the same. Accordingly, the starting points of both accumulators 24 and 26 are always synchronized so that the accumulator 26 which sequentially accumulates the output F′ of the adder 25, that is the sum of the accumulated value $qF_A$ and the frequency information $F_B$, under control of the clock pluse $\phi$ repeatedly generates an accumulated value qF′ which varies in the same manner as the identical pair of the frequency informations $F_A$ and $F_B$. Consequently, for the identical pair of the frequency informations $F_A$ and $F_B$, a musical tone signal having the same waveform is sequentially read out from the waveform memory device 9 when the addresses thereof are designated by the accumulated value qF′.

Figure 5:
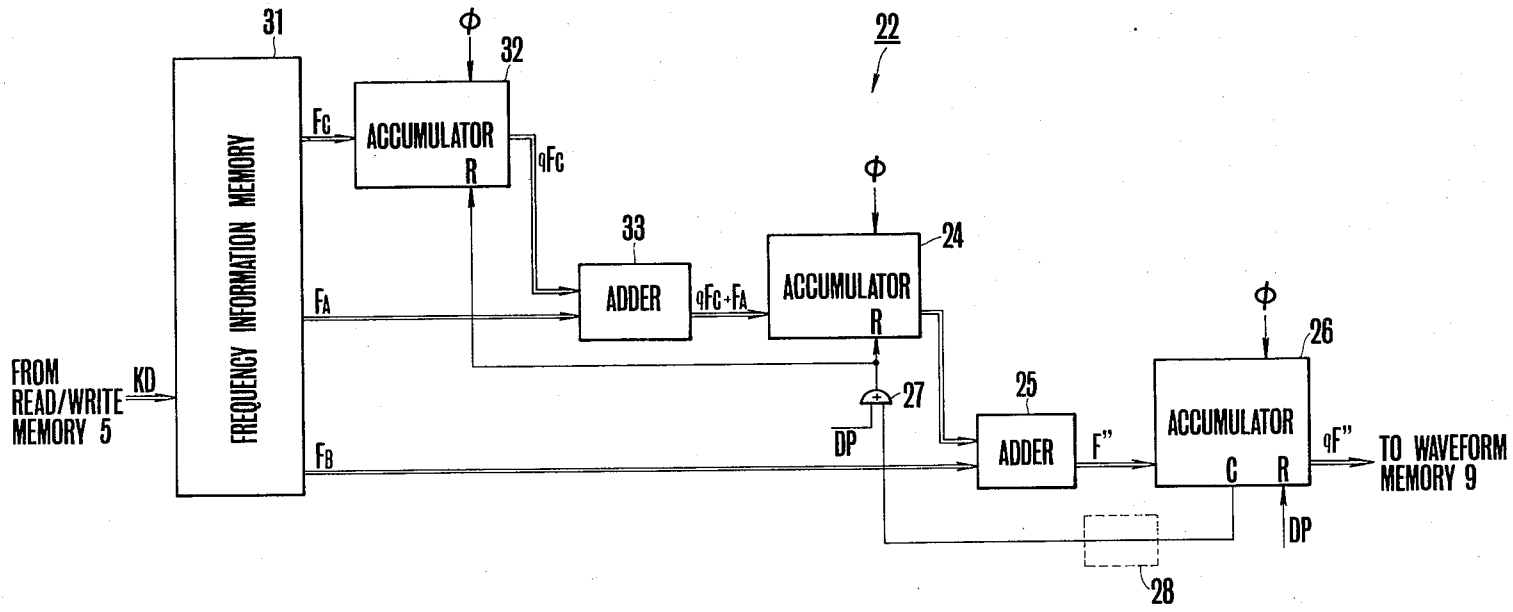

FIG. 5 shows a modification of the electronic musical instrument of this invention, more particularly a modification of the address signal generating circuit 22 in which elements corresponding to those shown in FIG. 3 are designated by the same reference numerals. This modified address signal generating circuit 22 comprises a frequency information memory device 31 having addresses read out by a key data KD supplied by the read/write memory devie 5 shown in FIG. 3. In each address is stored a set of three types of frequency informations $F_A$, $F_B$ and $F_C$ related to the pitch tones of respective keys. There are further provided an accumulator 32 which sequentially accumulates the frequency information $F_C$ under control of clock pulse $\phi$ and a adder 33 which adds the accumulated value $qF_C$ of the accumulator 32 to the frequency information $F_A$ and applies the sum to the other accumulator 24. Thus, this modification is different from the first embodiment shown in FIG. 3 in that the sum of the accumulated value $qF_C$ produced by accumulating the frequency information $F_C$, and the frequency information $F_A$ is applied to the accumulator 24.

When compared with the address signal generating circuit 22 shown in FIG. 3, this modified address signal generating circuit has one additional accumulator so that the accumulated value qF″ supplied to the last accumulator 26 varies as a third order function. Accordingly, the waveform read out from the waveform memory device varies with time more complexly.

As above described according to this invention the frequency information related to the frequency of a musical tone to be generated is varied with time, the frequency information is accumulated for a predetermined time and the accumulated value of the frequency information is used to designate the addresses of a waveform memory device storing a desired musical tone waveform for reading out the same, so that it is possible to complexly vary the speed of changing the addresses of the waveform memory device thereby changing the waveform read out from the waveform memory device. In other words, it is possible to readily produce musical tones having different colors from a single waveform memory device storing a simple waveform.

What is claimed is:

1. An electronic musical instrument, comprising:

frequency information generating means for generating frequency information representative of a tone pitch associated with a depressed key;

frequency information varying means for producing a frequency information varying signal which changes with time during each period of said tone pitch;

means for combining said frequency information varying signal with said frequency information to produce a combined signal which changes during each period of said tone pitch and which is determined by the values of the frequency information varying signal and the frequency information;

accumulating means, having a modulus and responsive to the combined signal, for accumulating said combined signal at a selected rate to provide an output signal of increasing value within the range of said modulus and for recycling when the output signal exceeds said modulus, the time between successive recyclings of the accumulating means defining a musical tone period, said frequency information and said varying signal being of such values that the musical tone period defined by the time between successive accumulating means recyclings is equal to one period of the tone pitch associated with the depressed key;

a waveform memory device having a plurality of addresses at which are stored a plurality of sampling point amplitude values representative of one period of a selected musical waveform, the waveform memory device being responsive to an address signal applied thereto for producing the amplitude value designated by the address signal;

a sound system, responsive to the amplitude values produced by said waveform memory, for converting a musical tone waveform read out from said waveform memory device into a musical tone; and means for applying the output signal from the accumulator as the address signal to the waveform memory device, whereby a musical waveform different from the selected musical waveform stored in the waveform memory device is produced by the instrument as the combined signal accumulated by the accumulating means progresses at a rate which is varied cyclically within said period.

2. An electronic musical instrument according to claim 1 wherein said frequency information varying means comprises: a further frequency information generating means for generating a further frequency information corresponding to the tone pitch of said depressed key, a further accumulating means which repeatedly accumulates said further frequency information, means to reset said further accumulating means when said first accumulating means recycles, and an adder for adding together an accumulated value of said further accumulating means and said first frequency information.

3. An electronic musical instrument according to claim 1 which further comprises an envelope waveform generating means and a multiplier connected between said waveform memory device and said sound system for modifying said musical tone waveform read out from said waveform memory device with the output of said envelope waveform generating means.

4. An electronic musical instrument, comprising:

frequency information generating means which generates first and second frequency informations related to a tone pitch of a depressed key;

first accumulating means for periodically and repeatedly accumulating said first frequency information at a rate greater than the period of said tone pitch of the depressed key to provide a first accumulator output signal;

an adding means for adding the said first accumulating means output signal and said second frequency information to provide an output signal representative of the sum thereof;

second accumulating means, having a modulus and responsive to the adding means output signal, for repeatedly accumulating said adding means output signal to accumulate a value which increases within the range of said modulus and for recycling when the accumulated value exceeds said modulus;

a waveform memory device, having a plurality of addresses at which are stored sampling point amplitude values representing a waveform corresponding to one period of a selected musical tone waveform, the waveform memory device being responsive to address signals applied thereto for producing the amplitude values designated by the address signal, the value in said second accumulating means being applied as the address signal to said waveform memory device for cylically designating said addresses to produce a waveform from the waveform memory device having a period determined by the time between recyclings of said second accumulator; and a sound system for converting a musical tone waveform produced by said memory device into a musical tone;

whereby said first accumulator means varies the value accumulated by said second accumulator to produce addresses for said waveform memory device to produce a waveform which is different than said selected musical tone waveform stored in said waveform memory device.

* * * * *

UNITED STATES PATENT AND TRADEMARK OFFICE

CERTIFICATE OF CORRECTION

PATENT NO. : 4,223,582

DATED : Sep. 23, 1980

INVENTOR(S) : Mitsumi Kato; Koji Niimi, of Hammamatsu, Japan

It is certified that error appears in the above-identified patent and that said Letters Patent are hereby corrected as shown below:

Col. 6, line 47, "date" should read -- data --

Col. 7, line 52, "qF=M" should be --qF'=M--

Signed and Sealed this

*First* Day of *September 1981*

[SEAL]

*Attest:*

GERALD J. MOSSINGHOFF

*Attesting Officer*

*Commissioner of Patents and Trademarks*